United States Patent [19]

Gorodissky et al.

[11] 4,122,691

[45] Oct. 31, 1978

[54] CHAMBER FOR TREATING BAND-TYPE MATERIAL UNDER OVERPRESSURE

[76] Inventors: Leonid G. Gorodissky, Dmitrovskoe shosse, 153/43, kv. 106, Moscow, U.S.S.R.; Nikolai T. Romanov, deceased, late of Moscow, U.S.S.R.; Anantasia I. by Romanova, administratrix, Bulatnikovsky proezd, 14, korpus 5, kv. 152, Moscow, U.S.S.R.

[21] Appl. No.: 833,075

[22] Filed: Sep. 14, 1977

[51] Int. Cl.[2] ..... D06B 23/18

[52] U.S. Cl. ..... 68/5 E; 34/242; 118/50

[58] Field of Search ..... 68/5 D, 5 E; 34/242; 432/242; 156/382; 23/290; 118/50; 425/363, 383

[56] References Cited

U.S. PATENT DOCUMENTS

| | | | |
|---|---|---|---|
| 2,834,193 | 5/1958 | Fahringer | 68/5 E |
| 3,906,755 | 9/1975 | Sando et al. | 68/5 E X |

*Primary Examiner*—Philip R. Coe

*Attorney, Agent, or Firm*—Steinberg & Blake

[57] ABSTRACT

The present invention relates to equipment for treating a band-type material and can be used most successfully in the textile finishing and dyeing industry. The chamber for treating a band-type material under overpressure is formed by hermetically joined arched bottom, arched roof and side walls built into flanges so that the chamber has a crescent cross section and is provided with throats located near the flanges. This layout of the chamber reduces considerably its metal content and allows a number of chambers to be combined into a single installation to be used both for prolonged single-stage treatment and for multiple-stage treatment of the material.

2 Claims, 2 Drawing Figures

CHAMBER FOR TREATING BAND-TYPE MATERIAL UNDER OVERPRESSURE

The present invention relates to equipment for treating band-type materials, for example textiles and industrial rubber goods and more particularly it relates to chambers for treating band-type materials, e.g. fabric, under overpressure.

The invention can be used to the best advantage in the textile finishing and dyeing industry for treating fabrics under overpressure, for example in a steam medium and will be described hereinbelow by way of example of treating fabric. However, it should be understood that the range of application of the invention is not limited to the example described below.

At present, in view of the necessity for intensification of the technological procedures the continuous methods of treating fabrics under overpressure acquire an ever-growing importance.

Treatment of fabric under overpressure is currently performed in chambers of various shapes, e.g. rectangular.

Each of these chambers is formed by hermetically joined bottom, roof and side walls. The bottom and the roof are either flat in rectangular chambers, or arched in cylindrical chambers. Besides, each chamber has flanges with slotted openings for admitting and discharging the fabric, transport devices for carrying the fabric through the chamber, hatches for fitting the fabric into the transport device and gates arranged over the slotted openings in the flanges.

Habitually, such chambers are very long and are intended for prolonged single-stage treatment of fabric.

Inasmuch as the fabric is treated in these chambers under overpressure, they are protected against failure by making them very solid with the walls reinforced with stiffener ribs which increases the amount of metal used for their manufacture. Besides, such chambers are characterized by a strong inertia since their heating and cooling takes much time.

When such chambers are combined into a single installation for multiple-stage and single-stage treatment of fabric there arise additional difficulties since the chambers have to be made with throats (narrow connectors between the chambers) or with special devices installed between the chambers for the passage of the fabric, both of which call for additional expenditures of metal.

An object of the present invention resides in eliminating the aforesaid disadvantages.

The main object of the present invention is to provide such a shape of the chamber for treating a band-type material under pressure which would reduce the metal content of said chamber without decreasing its permissible pressure and still retaining its output.

Another object of the present invention is to provide such a chamber for treating a band-type material under overpressure which would be easily combined with other similar chambers into a single installation for treating a band-type material under overpressure without the use of any additional devices between said chambers.

And still another object of the invention is to provide such a chamber for treating a band-type material under overpressure whose explosion hazard would be brought to a minimum.

In accordance with these and other objects we provide a chamber for treating a band-type material under overpressure comprising a hermetically joined roof, an arched bottom, side walls and having flanges with slotted openings for the admission and discharge of the material, a material-transport device, hatches and gates arranged over the slotted openings in the flanges wherein, according to the invention, the roof is also of an arched shape which forms, together with the bottom, and the side walls a chambers of a crescent cross section provided with throats near the flanges.

In accordance with the invention, the chamber has a steam jacket arranged equidistantly from the arched roof which prevents dripping from said roof.

This shape of the chamber reduces its metal content by 20–40% and curtails considerably the time required for heating or cooling the chamber.

The throat formed by the arched roof and bottom allows these chambers to be combined into a single installation without the necessity for introducing any additional devices between them.

Besides, this shape of the bottom and roof vacates a space for the fastening elements required for joining the chamber flanges to each other.

Installation of such chambers in a single line makes them useful both for multiple-stage and single-stage treatment of a band-type material. This combination of chambers makes it possible to reduce the volume of each one without the detriment to the technology of treatment of the band-type material since prolonged treatment can be carried out in several consecutive chambers which reduces considerably explosiveness of the whole device.

Now the chamber for treating fabric under overpressure according to the invention will be described in detail by way of example with reference to the accompanying drawings, in which.

Figure 1:
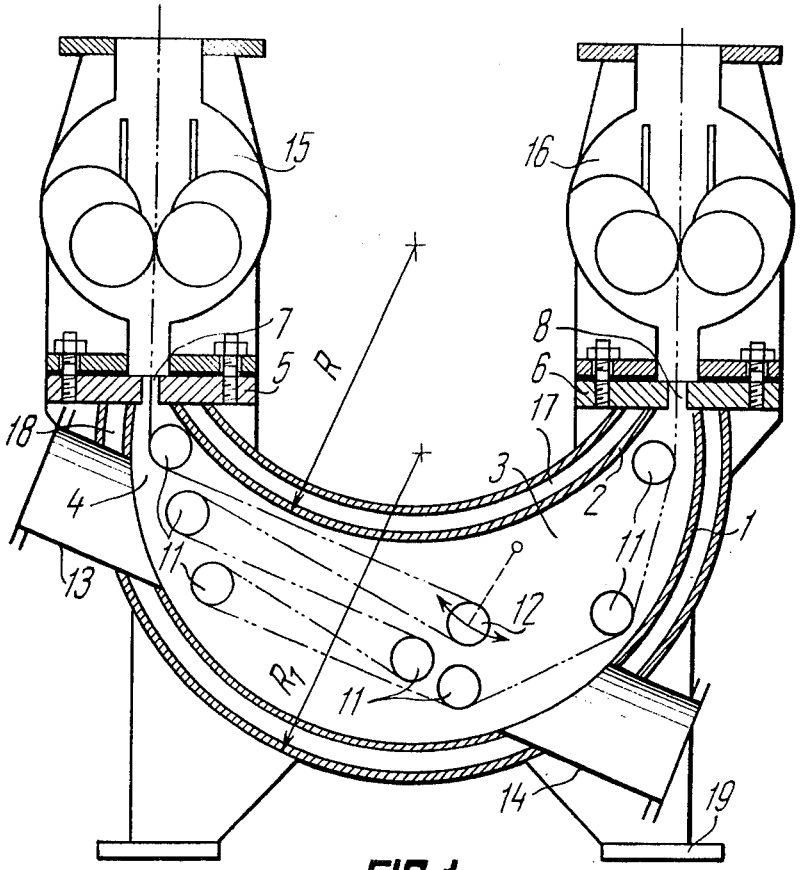
FIG. 1 is a schematic longitudinal partial section of the chamber according to the invention.

The chamber (FIG. 1) for treating a band-type material, e.g. fabric, under overpressure is formed by hermetically joined arched bottom 1, arched roof 2 and side walls 3 which can be flat and provided with stiffener ribs (not shown in the drawing). The curvature radius R of the roof 2 has the same sign as the curvature radius $R_1$ of the bottom 1 but the values can be the same or different in magnitude so that the chamber has a crescent shape in cross section. The length of the arch of the roof 2 in such a chamber is smaller than that of the bottom 1 so that a space 4 is formed between the bottom and the roof, said space getting narrower as the bottom and roof come closer to each other (see FIG. 1).

At the sides of the chamber the bottom 1 and the roof 2 fit into flanges 5 and 6 which are disposed in one and the same horizontal plane.

Each of the flanges 5 and 6 has a slotted opening 7 and 8, respectively. The slotted opening 8 is intended for admitting the fabric into the chamber space 4 whilst the slotted opening 7 serves for discharging the fabric. The width and length of the openings 7 and 8 is chosen on the basis of common laws to suit the application of the chamber and its concrete conditions of service.

Figure 2:
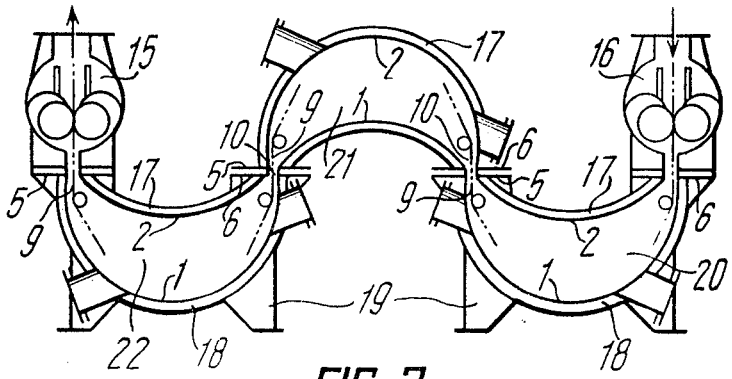
FIG. 2 shows the arrangement of the chambers combined into a single installation for treating a band-type material under overpressure.

In so far as the chamber space 4 near the flanges 5 and 6 is narrower, the arched bottom 1, roof 2 and side walls form throats 9 and 10, respectively (FIG. 2).

The space 4 of the chamber (FIG. 1) accommodates a fabric-transport device formed, say, by guide rollers 11 and a take-up roller 12 whose design is universally known to those skilled in the art, or by any other elements transporting the fabric in the course of its treatment.

The guide rollers 11 in the space 4 can be arranged in any convenient order depending on the actual operating conditions of the chamber.

The arched bottom 1 has two hatches 13 and 14 set opposite each other on the chord of the circumference. The hatches 13 and 14 are of any conventional design and their purpose is for inspecting the chamber and for cleaning thereof as well as for fitting-in the fabric on the guide rollers 11.

The gates 15 and 16 of a conventional design are arranged over the slotted openings 7 and 8 of the flanges. Thus, the gate 16 is intended to retain the preset overpressure in the chamber while the latter is loaded with fabric whereas the gate 15 retains the preset overpressure in the chamber when the fabric is taken out.

A steam jacket 17 arranged along the arched roof 2 of the chamber prevents formation of drops. The bottom can also be provided with a steam jacket 18.

The chamber is provided with lugs for ease of mounting. It should be understood that the chamber is fitted with all the necessary pipes, electric wiring, driving devices, sealing elements, etc. that go to ensure normal functioning of the chamber in the course of fabric treatment; these items are not shown in the drawing since their presence is obvious to those skilled in the art.

In the course of treating the fabric in the chamber shown in FIG. 1 the fabric passes through the gate 16 and opening 8 and moves over the guide rollers 11 through the space 4 where the requisite treatment takes place.

The treated fabric is discharged through the opening 7 and gate 15. Fresh portions of the fabric are loaded into the chamber through the hatches 13 and 14.

Shown in FIG. 2 schematically is an installation for treating fabric under overpressure formed by a number, (e.g. three) similar chambers 20, 21 and 22 realized as shown in FIG. 1.

The flanges 5 and 6 of the chamber 21 are connected, respectively, with the flange 6 of the chamber 22 and the flange 5 of the chamber 20. The chamber throats 9 and 10 serve as intermediate devices to carry the fabric between the chambers 20, 21 and 22.

The flange 6 of the chamber 20 mounts a gate 16 for admitting the fabric into the chamber whereas the gate 15 is installed on the flange 5 of the chamber 22 and serves for discharging the fabric from the chamber.

Since the chamber 21 is turned upside down with respect to the chambers 20 and 22, the length of the arch of the roof 2 is considerably larger than that of the bottom 1 as shown in FIG. 2, and the hatches 13 and 14 are made in the roof as it is also shown in FIG. 2.

In such an installation the fabric passes through the gate 16 and moves into the fabric-transport device of the chamber 20. Then it moves through the throats 10 and 9 and the slotted openings in the flanges 6 and 5 into the chamber 21. In a similar manner the fabric moves into the chamber 22 and leaves it through the gate 15.

We claim:

1. A chamber for treating a band-type material under overpressure comprising: side walls; an arched bottom; an arched roof hermetically joined with said bottom and side walls and made in such a manner that the chamber has a crescent cross section; flanges secured on said arched bottom, roof and side walls; throats formed by said arched bottom and arched roof and located near said flanges; slotted openings in said flanges, intended for admitting and discharging the band-type material into and out of the chamber; a device for transporting the band-type material; hatches provided for visual inspection and for fitting the band-type material into said material-transport device; gates arranged over said slotted openings and intended to pass the band-type material and to retain pressure in the chamber at a preset level.

2. A chamber according to claim 1 wherein there is a steam jacket arranged equidistantly from the roof.

* * * * *